US012759756B2

(12) United States Patent
Wei et al.

(10) Patent No.: US 12,759,756 B2
(45) **Date of Patent: *Oct. 13, 2026**

(54) PALLET FOOT

(71) Applicant: MICROONE GREEN MANUFACTURING SOLUTION CO., LTD., Jiaxing City (CN)

(72) Inventors: Shengrong Wei, Jiaxing City (CN); Zheng Ye, Jiaxing City (CN); Yongping Gong, Jiaxing City (CN); Mingsong Hao, Jiaxing City (CN); Xianbing Lu, Jiaxing City (CN); Jinbo Lou, Jiaxing City (CN); Weijie Zhang, Jiaxing City (CN)

(73) Assignee: MICROONE GREEN MANUFACTURING SOLUTION CO., LTD., Jiaxing City (CN)

( * ) Notice: Subject to any disclaimer, the term of this patent is extended or adjusted under 35 U.S.C. 154(b) by 60 days.

This patent is subject to a terminal disclaimer.

(21) Appl. No.: 18/900,095

(22) Filed: Sep. 27, 2024

(65) Prior Publication Data

US 2025/0382095 A1 Dec. 18, 2025

(30) Foreign Application Priority Data

Jun. 17, 2024 (CN) ..... 202421382720.4

(51) Int. Cl.
*B65D 19/00* (2006.01)

(52) U.S. Cl.
CPC ..... *B65D 19/0028* (2013.01); *B65D 2519/00736* (2013.01)

(58) Field of Classification Search
CPC ..... B65D 19/0028; B65D 19/40; B65D 2519/00736; B65D 2519/00059; B65D 2519/00069; B65D 2519/00323; B65D 2519/00572; B65D 2519/00825; B65D 2519/00273; B65D 2519/00338; B65D 2519/00562; B65D 2519/00786; B65D 2519/0094
USPC ..... 108/51.11, 56.1, 56.3, 53.1, 53.3, 53.5, 108/57.21–57.24, 57.29, 57.31–57.33; 248/346.02, 94, 246.5, 188.8; 206/386, 206/597, 600
See application file for complete search history.

(56) References Cited

U.S. PATENT DOCUMENTS

| | | | | |
|---|---|---|---|---|
| 2,844,344 | A * | 7/1958 | Streb | B65D 19/385 108/53.5 |
| 2025/0178784 | A1* | 6/2025 | Ye | B65D 19/0075 |
| 2025/0382094 | A1* | 12/2025 | Hao | B65D 19/0006 |
| 2025/0382096 | A1* | 12/2025 | Lou | B65D 19/0075 |

FOREIGN PATENT DOCUMENTS

| | | | | |
|---|---|---|---|---|
| EP | 3670375 | A1 * | 6/2020 | B65D 19/40 |
| GB | 937354 | A * | 9/1963 | B65D 19/40 |
| WO | WO-0071431 | A1 * | 11/2000 | B65D 19/0008 |
| WO | WO-2021136854 | A1 * | 7/2021 | B65D 19/40 |

* cited by examiner

*Primary Examiner* — Janet M Wilkens

(57) ABSTRACT

A pallet foot is provided. The pallet foot includes a guide portion and a support portion located below the guide portion. An opening is formed in a top of the guide portion. The guide portion is internally provided with a stretching space in a shape of a reverse taper. A cavity is formed in the support portion. The cavity is connected with the stretching space.

8 Claims, 4 Drawing Sheets

PALLET FOOT

CROSS-REFERENCE TO RELATED APPLICATION

This patent application claims the benefit and priority of Chinese Patent Application No. 2024213827204, entitled "PALLET FOOT" filed on Jun. 17, 2024, the disclosure of which is incorporated by reference herein in its entirety as portion of the present application.

TECHNICAL FIELD

The present disclosure relates to the technical field of feet, and more specifically relates to a pallet foot.

BACKGROUND

At present, most of the existing standard iron pallets continue to use pallet foot modes of plastic pallets or wooden pallet pallets, and a square or rectangular foot with large volume is manufactured from a thin iron plate. The distance between upper pallet and the lower pallet is large, and a large space is occupied. At the same time, when the upper pallet and the lower pallet are stacked, it is difficult to ensure the up-and-down alignment, especially in the application of AGV (Automatic Guided Vehicle) trolleys, an auxiliary alignment device is necessary to barely meet the basic alignment requirements, and it is difficult to achieve accurate positioning and alignment. Moreover, the carrying weight is limited. When more than ten tons of articles need to be carried, the standard iron pallet on the market can no longer carry the heavy articles, and the special steel frame needs to be manufactured.

The iron stacking transport racks are similar in foot cups and support rods. Generally, the foot cups are placed below and are served as support portions. During stacking, the foot cups fall above the support legs for stacking limit and slip prevention, but the structure has the following disadvantages.

Firstly, the foot cups do not have high requirements on size, shape and positioning precision. It is convenient to stack up and down because of large size of the foot cups. The foot cup is located at the lower portion, and the support rod is located at the upper portion. Thus, the size of the foot cup is large, and exceeds the frame size of the transport rack, resulting in the waste of volume area.

Secondly, when the foot cup falls to the ground, the ground is easily damaged by the edge.

Thirdly, the combined height of the foot cup and the support rod must be very high to form a stacking space, therefore, the vacant iron transport racks need larger stacking space than the pallets.

Fourthly, the combined height of the foot cup and the support rod is very high, such that the possibility that the upper side and the lower side are in a vertical line becomes almost impossible. If the bottom portion is offset a little from the vertical line, the upper portion will be offset a lot. If the foot cup of the iron transport rack is placed above, uneven stacking is caused to result in stacking risk. At the same time, when the support rod falls to the ground, and the contact area with the ground is small, such that the support rod is more unstable to result in greater risks because this structure is not safe and usable.

Fifthly, when the foot cup and the support rod are welded together, the height is fixed, and the stacking height cannot be adjusted any more. If the height of the storage articles changes, a new iron stacking transport rack needs to be manufactured additionally. The waste of resources is great.

Therefore, it is necessary to design a novel pallet foot to meet the above-mentioned large-weight carrying. At the same time, the pallet application requirements of pallet stacking and positioning prevision are can also be met, and the problems of the iron stacking transport rack, such as floor protection, volume space saving, no vertical alignment, difficulty in height adjustment, are solved.

SUMMARY

Aiming at the shortcomings in the prior art, the present disclosure provides a pallet foot so as to solve the above-mentioned technical problems.

To achieve the above purpose, the present disclosure provides the following technical scheme.

A pallet foot includes a guide portion and a support portion located below the guide portion. An opening is formed in a top of the guide portion. The guide portion is internally provided with a stretching space in a shape of a reverse taper. A cavity is formed in the support portion. The cavity is connected with the stretching space.

Further, a ground protection structure is provided at a bottom of the support portion.

Further, the guide portion is in a shape of an inversed pyramid, a polygonally taper or an inverted cone, and the stretching space inside the guide portion is also in a shape of an inversed pyramid, a polygonally taper or an inverted cone.

Further, the support portion is in a shape of a circular tube, a square tube, a rectangular tube or a polygonal tube.

Further, the support part and the guide part are provided with auxiliary structures, and the auxiliary structures are auxiliary holes.

Further, an elongation portion is provided at a top of the guide portion, and the elongation portion extends upwards along an upper side of the guide portion.

Further, the guide portion is welded or integrally formed with the support portion. Further, an upper dimension of the guide portion is smaller than or equal to twice of an overall dimension of the support portion.

Preferably, an overall dimension of the support portion is smaller than or equal to a lower dimension of the guide portion, and the lower dimension of the guide portion is smaller than or equal to the overall dimension of the support portion plus 5 mm.

Further, a height of the pallet foot is smaller than or equal to 250 mm.

Compared with the prior art, the embodiments have the following beneficial effects.

According to the pallet foot in the embodiments, the guide portion and the support portion are provided. The guide portion is configured to be matched and connected with a pallet body to transfer and share loads. A pallet is integrally supported and carried by the support portion. In addition, the opening, the stretching space and the cavity are provided, such that when the pallets are stacked, the foot of a previous pallet can be guided and stretched through the opening and the stretching space to finally enter into the cavity. Thus, when the pallets are stacked, the foot of the pallet can be stretched into the stretching space and the cavity of a lower pallet separately to realize no large space between the upper pallet and the lower pallet during stacking, and the space is effectively saved.

Moreover, the ground protection structure, the auxiliary structure and the elongation portion are provided, such that the function of the pallet foot and the connection effect between the pallet foot and the pallet body are better.

In addition, by controlling the height and the dimension of the guide portion and the height and the dimension of the support portion, it is possible to control the manufacturing accuracy of the pallet foot and the application of integral forming technology. The processing accuracy of the pallet foot is improved, such that the vertical accuracy and the positioning accuracy of the pallet can be controlled well. A tubular inserted rod is applied to be inserted into the support portion of the pallet foot. In cooperation with a guide inverted taper, the stacking height of a stacking rack can be elongated well. The vertical precision is high, such that the stacking up-and-down positioning is precision. The tubular inserted rod is an assembled component, therefore the stacking height can also be adjusted.

BRIEF DESCRIPTION OF THE DRAWINGS

In order to illustrate the technical scheme in the embodiment of the present disclosure more clearly, the drawings needing to be used in the embodiment are simply described. Apparently, the embodiments in the following description are merely a portion rather than all of the embodiments of the present disclosure. For those skilled in the art, under the premise of without contributing creative labor, otherwise than drawings further can be obtained according to these drawings.

Figure 1:
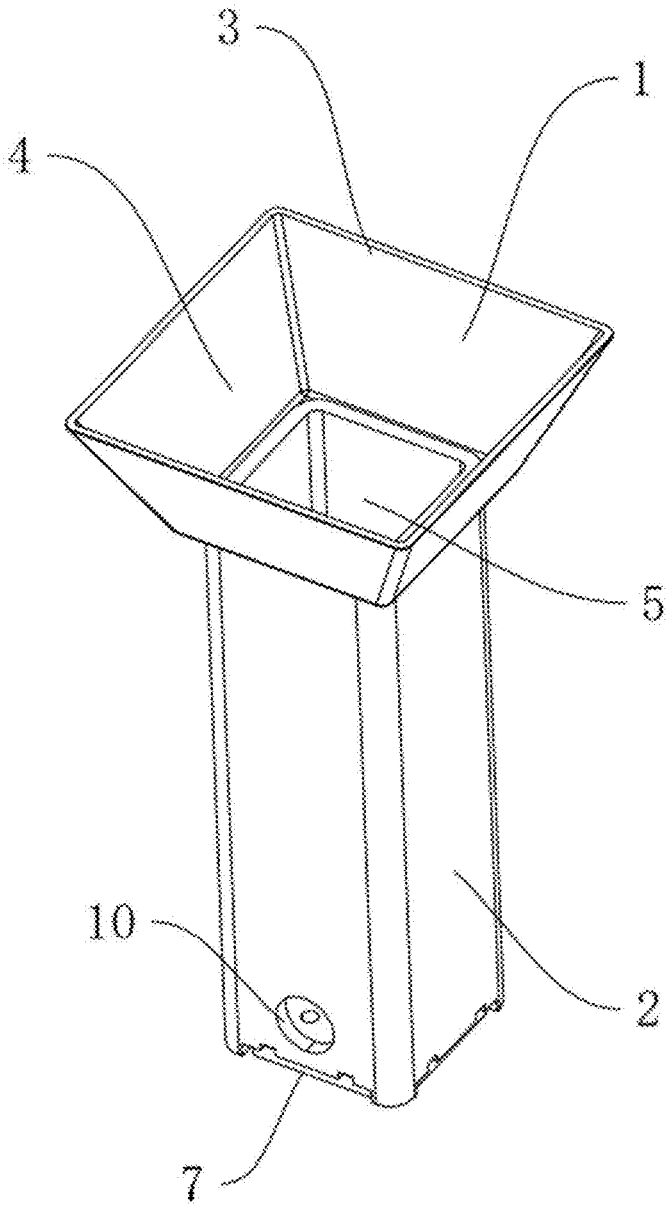
FIG. 1 is a first structural schematic diagram of a pallet foot (according to the first embodiment).

List of the reference characters: 1 guide portion; 2 support portion; 3 opening; 4 stretching space; 5 cavity; 6 mounting groove; 7 base plate; 8 through hole; 9 connecting groove; 10 auxiliary hole; and 11 elongation portion.

DETAILED DESCRIPTION OF THE EMBODIMENTS

In the description of the present disclosure, it needs to be illustrated that for location words, the indicative direction or position relations of the terms such as "center", "transverse (X)", "longitudinal (Y)", "vertical (Z)", "length", "width", "thickness", "upper", "lower", "front", "rear", "left", "right", "vertical", "horizontal", "top", "bottom", "inside", "outside", "clockwise" and "anti-clockwise" are direction or position relations illustrated based on the drawings, just for facilitating the description of the present disclosure and simplifying the description, but not for indicating or hinting that the indicated device or element must be in a specific direction and is constructed and operated in the specific direction, the terms cannot be understood as the restriction of the present disclosure.

In addition, the terms "first" and "second" are merely intended for a purpose of description, and shall not be understood as an indication or implication of relative importance or implicit indication of the number of indicated technical features. Therefore, a feature limited by "first" or "second" may explicitly or implicitly include one or more features. In the description of the present disclosure, "multiple" and "a plurality of" mean two or more unless expressly specifically defined otherwise.

Embodiment I

A pallet foot, as shown in FIG. 1, includes a guide portion 1 and a support portion 2 located below the guide portion 1. An opening 3 is formed in a top of the guide portion 1. The guide portion 1 is internally provided with a stretching space 4 in a shape of a reverse taper. A cavity 5 is formed in the support portion 2. The cavity 5 is connected with the stretching space 4.

According to the pallet foot in the present disclosure, the guide portion 1 and the support portion 2 are provided. The guide portion 1 is configured to be matched and connected with a pallet body to transfer and share loads. A pallet is integrally supported and carried by the support portion 2. In addition, the opening 3, the stretching space 4 and the cavity 5 are provided, such that when the pallets are stacked, the foot of a previous pallet can be guided and stretched through the opening and the stretching space to finally enter into the cavity 5. Thus, when the pallets are stacked, the foot of the pallet can be stretched into the stretching space 4 and the cavity 5 of a lower pallet separately to realize no large space between the upper pallet and the lower pallet during stacking, and the space is effectively saved.

Preferably, the bottom of the support portion 2 is provided with a ground protection structure, such that the ground is protected when the support portion 2 is in contact with the ground for supporting.

Preferably, a mounting groove 6 is formed at a bottom of the support portion 2. The ground protection structure is a base plate 7. The base plate 7 is installed in the mounting groove 6. The mounting groove 6 allows the base plate 7 to be accurately positioned on the support portion 2.

Preferably, the upper dimension of the guide portion 1 is smaller than or equal to twice of the overall dimension of the support portion 2.

Preferably, the overall dimension of the support portion 2 is smaller than or equal to the lower dimension of the guide portion 1, and the lower dimension of the guide portion 1 is smaller than or equal to the overall dimension of the support portion 2 plus 5 mm.

Preferably, multiple through holes 8 are formed in the base plate 7 to facilitate the installation of a plastic wear-resistant protective sheet at the bottom of the base plate 7 to prevent scratching the ground, and a connecting groove 9 connected with the mounting groove 6 is formed in a side surface of the bottom of the support portion 2, such that the base plate 7 can be firmly welded to the support portion 2.

Preferably, the guide portion 1 is in a shape of an inversed pyramid, a polygonally taper or an inverted cone, and the stretching space 4 inside the guide portion 1 is also in a shape of an inversed pyramid, a polygonally taper or an inverted cone. The guide portion 1 and the stretching space 4 may also be in other shapes as long as the stretching space 4 in the shape of the reverse taper is provided with an enlarged stretching port and has a guide function for the previous foot.

Preferably, the support portion 2 is in a shape of a circular tube, a square tube, a rectangular tube or a polygonal tube.

Preferably, the support portion 2 and the guide portion 1 are provided with auxiliary structures. The auxiliary structures are auxiliary holes 10. The auxiliary holes 10 in the guide portion 1 are configured for hoisting the pallet. The auxiliary holes in the support portion 2 are matched and fixed with auxiliary tools of the pallet, and are configured for mounting the auxiliary tools of the pallet.

Preferably, the overall height of the pallet foot is smaller than or equal to 250 mm, and the overall height includes a guide portion 1 and a support portion 2.

Embodiment II

Figure 2:
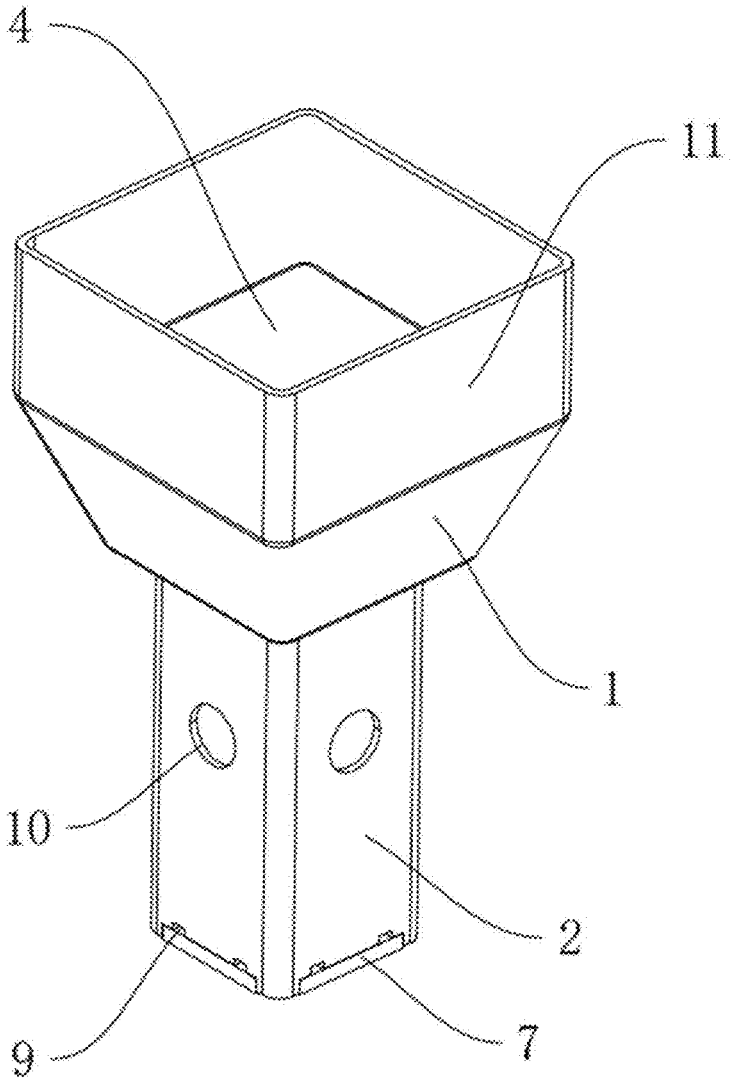
FIG. 2 is a second structural schematic diagram of a pallet foot (according to the second embodiment).
Figure 3:
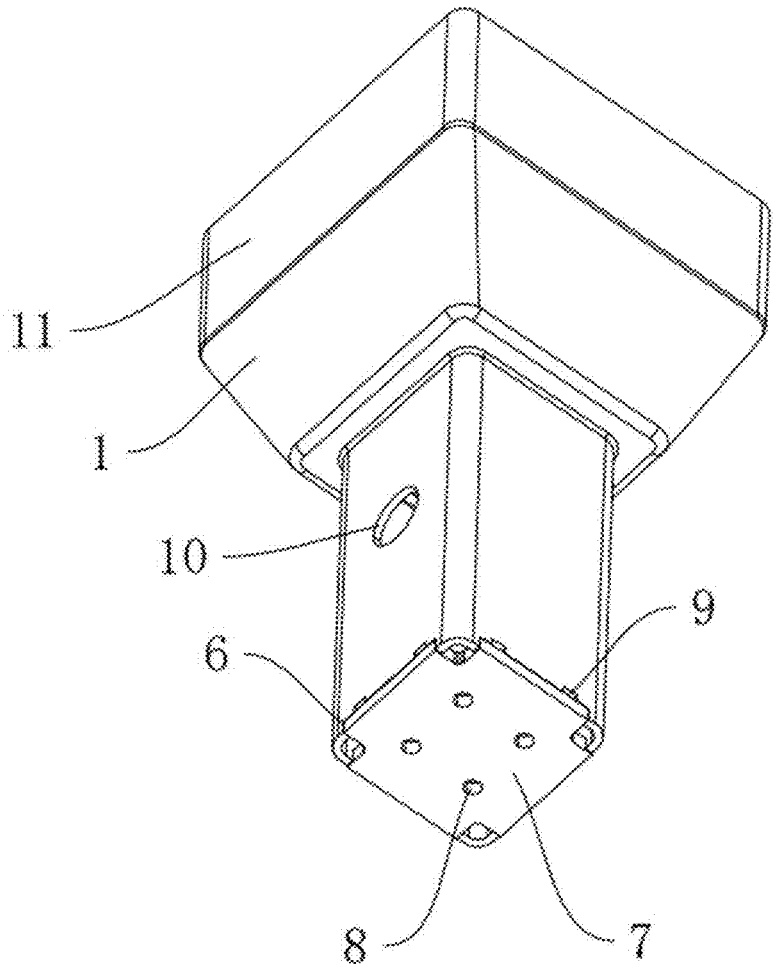
FIG. 3 is a third structural schematic diagram of a pallet foot (according to the second embodiment).

As shown in FIG. 2 to FIG. 3, the remaining features of a pallet foot are the same as those in the embodiment I. The difference are as follows. An elongation portion 11 is provided at the top of the guide portion 1. The elongation portion 11 extends in an upper direction of the guide portion 1. Through the arrangement of the elongation portion 11, the height dimension of the overall guide portion 1 may be elongated, such that the assembly connection with a pallet body is facilitated. In addition, preferably, mounting holes also may be formed in the elongation portion 11, and the mounting holes are connected with the pallet body through bolts.

Specifically, through the arrangement of the elongation portion 11, the elongation portion 11 can be convenient for hoisting and the conduction of the strengthening force, such that the stress on the pallet can be better transmitted to the support portion 2.

Preferably, the guide portion 1 is welded and connected with the support portion 2, such that the guide portion 1 and the support portion 2 as well as the elongation portion 11 and the support portion 2 are divided into two portions and are convenient to manufacture. The guide portion 1 and the support portion 2 are assembled through welded connection during assembling.

Preferably, the overall height of the pallet foot is smaller than or equal to 250 mm, and the overall height includes the height of the guide portion 1, the height of the support portion 2 and the height of the elongation portion 11.

Embodiment III

Figure 4:
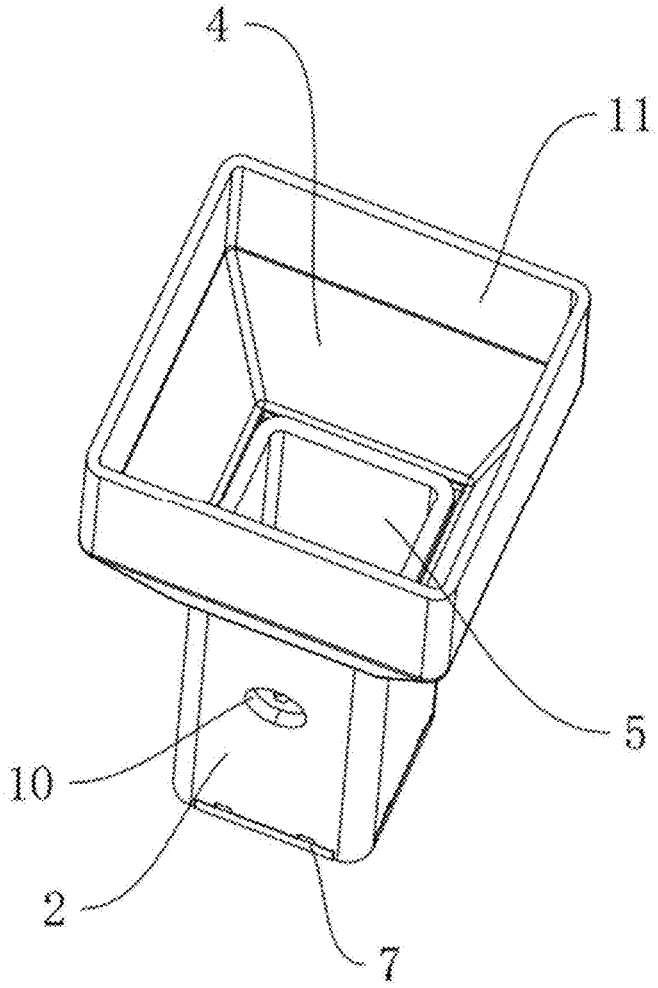
FIG. 4 is a fourth structural schematic diagram of a pallet foot (according to the third embodiment).

As shown in FIG. 4, the remaining features of a pallet foot are the same as those in the embodiment I. The difference are as follows. An elongation portion 11 is provided at the top of the guide portion 1. The elongation portion 11 extends in an upper direction of guide portion 1.

Preferably, the guide portion 1 and the support portion 2 are integrally formed, such that the overall integrity of the pallet foot is high.

The above mentioned is just the preferable embodiments of the present disclosure, the scope of protection of the present disclosure is not limited to the above embodiments, and the technical scheme in basically same means belongs to the scope of protection in the present disclosure. It should be noted that for those of ordinary skill in the art, several improvements and modifications may further be made without departing from the principle of the present disclosure.

What is claimed is:

1. A pallet foot, comprising a guide portion and a support portion located below the guide portion, wherein an opening is formed in a top of the guide portion, the guide portion is internally provided with a stretching space in a shape of a reverse taper, a cavity is formed in the support portion, and the cavity communicates with the stretching space; wherein an overall dimension of the support portion is smaller than or equal to a lower dimension of the guide portion, and the lower dimension of the guide portion is smaller than or equal to the overall dimension of the support portion plus 5 mm.

2. The pallet foot according to claim 1, wherein a ground protection structure is provided at a bottom of the support portion.

3. The pallet foot according to claim 1, wherein the guide portion is in a shape of an inversed pyramid, a polygonally taper or an inverted cone, and the stretching space inside the guide portion is also in a shape of an inversed pyramid, a polygonally taper or an inverted cone.

4. The pallet foot according to claim 1, wherein the support portion is provided with auxiliary structures, and the auxiliary structures are auxiliary holes.

5. The pallet foot according to claim 1, wherein an elongation portion is provided at a top of the guide portion, and the elongation portion extends upwards along an upper side of the guide portion.

6. The pallet foot according to claim 1, wherein the guide portion is welded or integrally formed with the support portion.

7. The pallet foot according to claim 1, wherein an upper dimension of the guide portion is smaller than or equal to twice an overall dimension of the support portion.

8. The pallet foot according to claim 3, wherein an upper dimension of the guide portion is smaller than or equal to twice an overall dimension of the support portion.

* * * * *